US007496974B1

(12) United States Patent
Kang

(10) Patent No.: US 7,496,974 B1
(45) Date of Patent: Mar. 3, 2009

(54) HEIGHT ADJUSTING WATER SAVING URINAL

(76) Inventor: Tae Cho Kang, 8462 Whitaker St., #47, Buena Park, CA (US) 90621

( * ) Notice: Subject to any disclaimer, the term of this patent is extended or adjusted under 35 U.S.C. 154(b) by 0 days.

(21) Appl. No.: 11/861,982

(22) Filed: Sep. 26, 2007

(51) Int. Cl.
*E03D 1/22* (2006.01)

(52) U.S. Cl. ..... 4/342; 4/301

(58) Field of Classification Search ..... 4/144.1, 4/213, 7, 309, 311, 341–342, 301, 307
See application file for complete search history.

(56) References Cited

U.S. PATENT DOCUMENTS

| | | | | |
|---|---|---|---|---|
| 746,324 | A | 12/1903 | Gillin | |
| 3,456,264 | A * | 7/1969 | Flagg | 4/645 |
| 4,137,579 | A | 2/1979 | Soler | |
| 5,153,947 | A | 10/1992 | Markles | |
| 5,606,747 | A * | 3/1997 | Dupont | 4/213 |
| 5,799,340 | A | 9/1998 | Hubrig et al. | |
| 5,867,847 | A | 2/1999 | Klawitter et al. | |
| 6,079,057 | A * | 6/2000 | Mette | 4/342 |
| 6,408,449 | B1 | 6/2002 | Aguirre | |
| 6,496,989 | B1 * | 12/2002 | Meiser | 4/420 |
| 6,910,230 | B1 * | 6/2005 | Schimmel | 4/300 |

* cited by examiner

*Primary Examiner*—Charles E Phillips
(74) *Attorney, Agent, or Firm*—Park Law Firm; John K. Park

(57) ABSTRACT

A height adjusting water saving urinal adapted to be connected to a flush toilet system, includes a bowl, a top opening, a bottom opening, a bottom drain opening, an extendable urinal, a connecting device and a seat that is provided on the top opening so that a female user can sit on the seat. The bowl has a basin, a top portion, and a bottom portion. The top opening is provided at the top portion of the bowl. The bottom drain opening is provided at the bottom portion of the bowl. The extendable urinal drain pipe extends from the bottom drain opening. The connecting device, provided at an end of the extendable urinal drain pipe, is for connecting the urinal to the flush toilet system. The extendable urinal drain pipe shares the main drain pipe of the flush toilet.

8 Claims, 6 Drawing Sheets

144
42
52
150
44
142
46
100
146
48
71
80
72
86
60

HEIGHT ADJUSTING WATER SAVING URINAL

BACKGROUND OF THE INVENTION

The present invention relates to a height adjusting water saving urinal.

More particularly, this invention relates to a height adjusting water saving urinal that conserves water a lot.

Still more particularly, the invention relates to a height adjusting water saving urinal in which the urinal part is easy to attach to or detach from the regular flush toilet.

A flush toilet or water closet (WC) is one of the most popular systems to discard human waste from indoors. It uses water to wash out the waste cleanly and efficiently.

These days, fresh water is in short supply as the population and the industry grow. It is estimated to be a global problem in the near future according to the researches.

The affluence of water is not true any more. Conserving water is becoming an imperatives in many industrialized countries.

Accordingly, a need for a height adjusting water saving urinal has been present for a long time considering imminence of the problem. This invention is directed to solve these problems and satisfy the long-felt need.

SUMMARY OF THE INVENTION

The present invention contrives to solve the disadvantages of the prior art.

An object of the invention is to provide a height adjusting water saving urinal.

Another object of the invention is to provide a height adjusting water saving urinal that conserves water a lot.

Still another object of the invention is to provide a height adjusting water saving urinal, which is convenient to upgrade a regular flush toilet.

For a regular flush toilet system having 1) a flush toilet having a top opening, a concave water pan, a bottom drain opening, and a water intake; 2) a first water tank connected to the water intake of the flush toilet; and 3) a first flush system having flush flipper, a manual handle, and a main drain pipe connected to the bottom drain opening of the flush toilet for flushing out waste-containing water in the concave water pan of the flush toilet, a height adjusting water saving urinal adapted to be connected to the flush toilet system which includes a bowl, a top opening, a bottom opening, an extendable urinal drain pipe, a connecting device and a seat that is provided on the top opening whereby a female user can sit on the seat.

The bowl has a basin, a top portion, and a bottom portion. The top opening is provided at the top portion of the bowl. The bottom drain opening is provided at the bottom portion of the bowl. The extendable urinal drain pipe extends from the bottom drain opening. The connecting device, provided at an end of the extendable urinal drain pipe, is for connecting the urinal to the flush toilet system.

The height of the urinal is controllable by the extendable urinal drain pipe.

The water saving urinal comprises a foot lever for controlling the height of the extendable urinal drain pipe, a wedge, a cable that connects between the foot lever and the wedge, and a collar having a gap into which the wedge is pulled by the cable. The collar rests on an outer pipe and surrounds an inner pipe that is connected to the bottom drain opening. The collar elastically tends to reduce the gap. The wedge adjusts the gap so that the collar is fastened or released around the inner pipe.

The urinal may further include a nozzle provided at the inside edge of the urinal. And, the height adjusting water saving urinal may further include a second water intake connected to the nozzle of the urinal and a flush lever for controlling the flow of water to the second water intake.

The nozzle is adapted to change the direction and types of flow.

The urinal may further include one or more nozzles provided along the inside edge of the urinal and a second water intake connected to the nozzle of the urinal, and the nozzles are connected directly to a running water system.

The urinal is adapted to detachably attach to the flush toilet.

The height adjusting water saving urinal may further include a support for supporting the urinal and the outer pipe.

The height adjusting water saving urinal may further include an S-shaped pipe portion for keeping gas within the drain pipes.

The urinal uses approximately twenty (20) to thirty (30) ounces of water per use.

The connecting device is adapted to connect the urinal to the flush toilet or directly to a sewer system.

Instead of the running water system connected directly, the urinal may further include a second water tank.

The urinal further comprises a lid.

The urinal further comprises a flexible coiled hose that connects between the bottom drain opening and the connecting device.

The nozzle comprises a plurality of water ejecting conduits.

The water ejecting conduits are arranged so that they have different water ejecting angles with respect to the basin of the bowl.

The water ejecting angles gradually increase from the lowermost water ejecting conduit to the uppermost water ejecting conduit.

The advantages of the present invention are: (1) the height adjusting water saving urinal conserves water a lot; (2) the height adjusting water saving urinal is easy to be installed on a regular flush toilet; and (3) the height of the urinal of the height adjusting water saving urinal can be adjusted easily.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
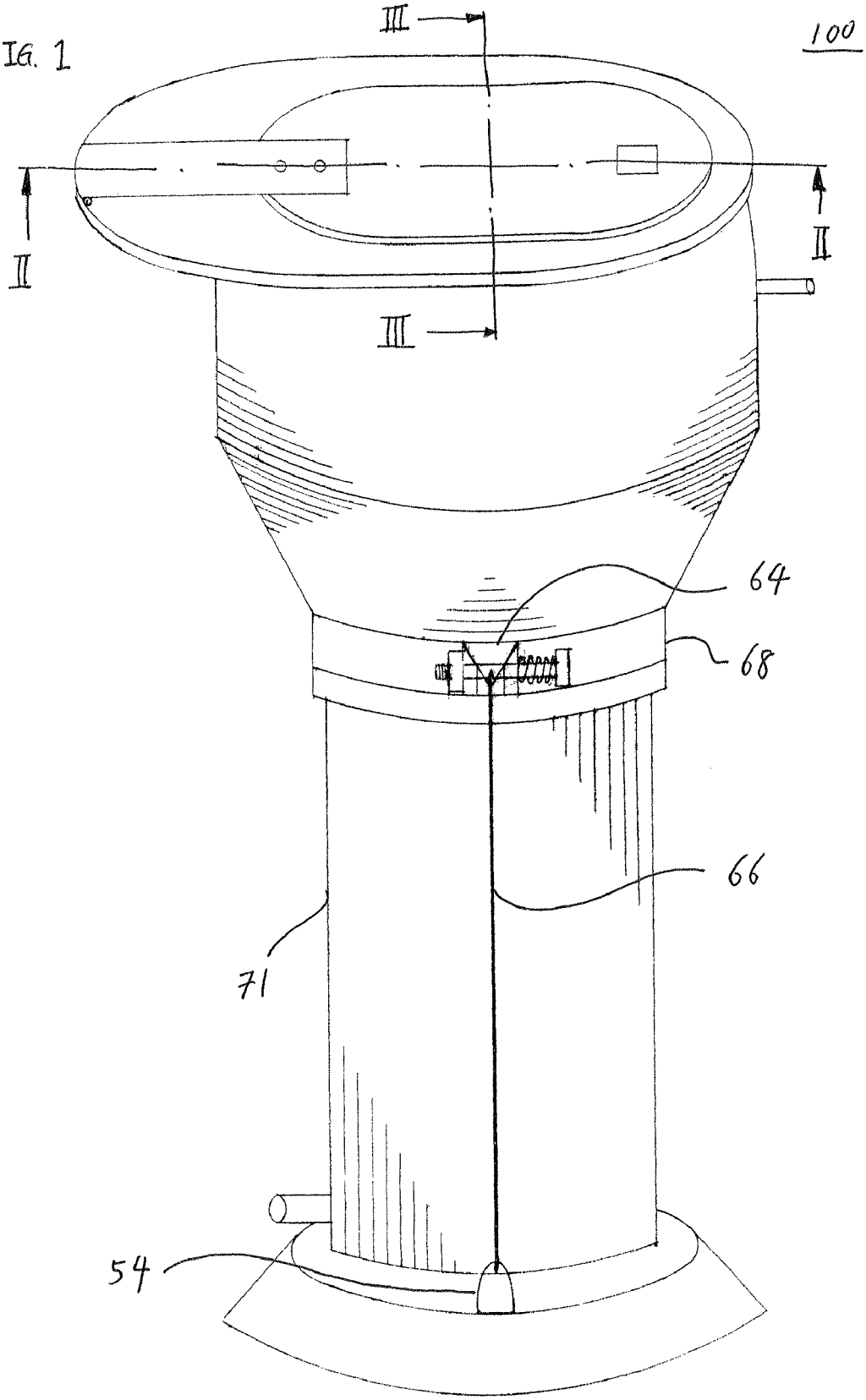
FIG. 1 is a perspective view showing a height adjusting water saving urinal according to the present invention.
Figure 7:
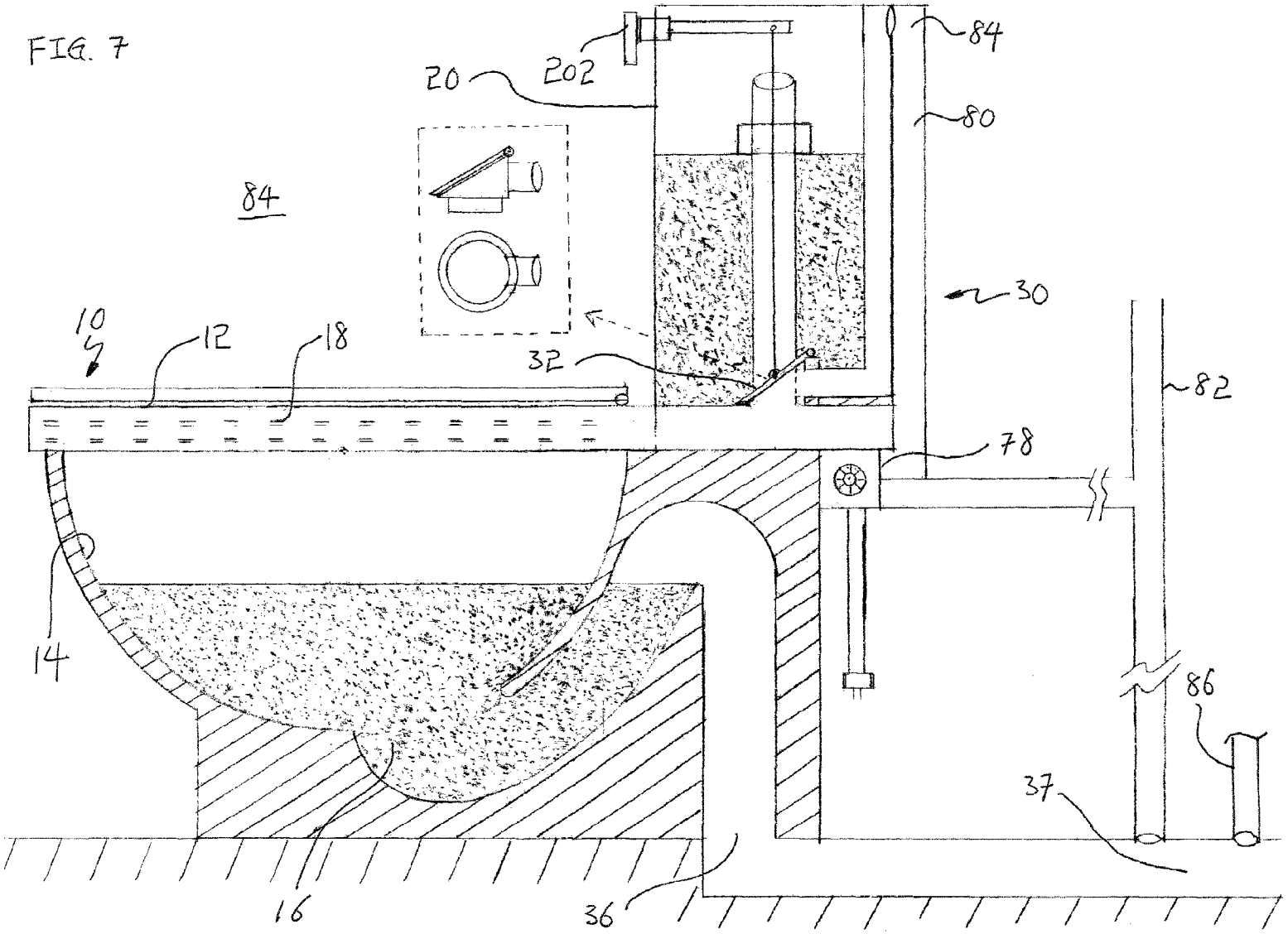
FIG. 7 is a cross-sectional view showing a suction device.

FIG. 1 shows a cross-sectional view of a height adjusting water saving urinal 100 that is adapted to be connected to a regular flush toilet system 84 (refer to FIG. 7).

For a regular flush toilet system 84 having 1) a flush toilet 10 having a top opening 12, a concave water pan 14, a bottom drain opening 16, and a water intake 18; 2) a first water tank 20 connected to the water intake 18 of the flush toilet 10; and 3) a first flush system 30 having a flush flipper 32, a manual handle 202, and a main drain pipe 36 connected to the bottom drain opening 16 of the flush toilet 10 for flushing out waste-containing water in the concave water pan 14 of the flush toilet 10.

Figure 2:
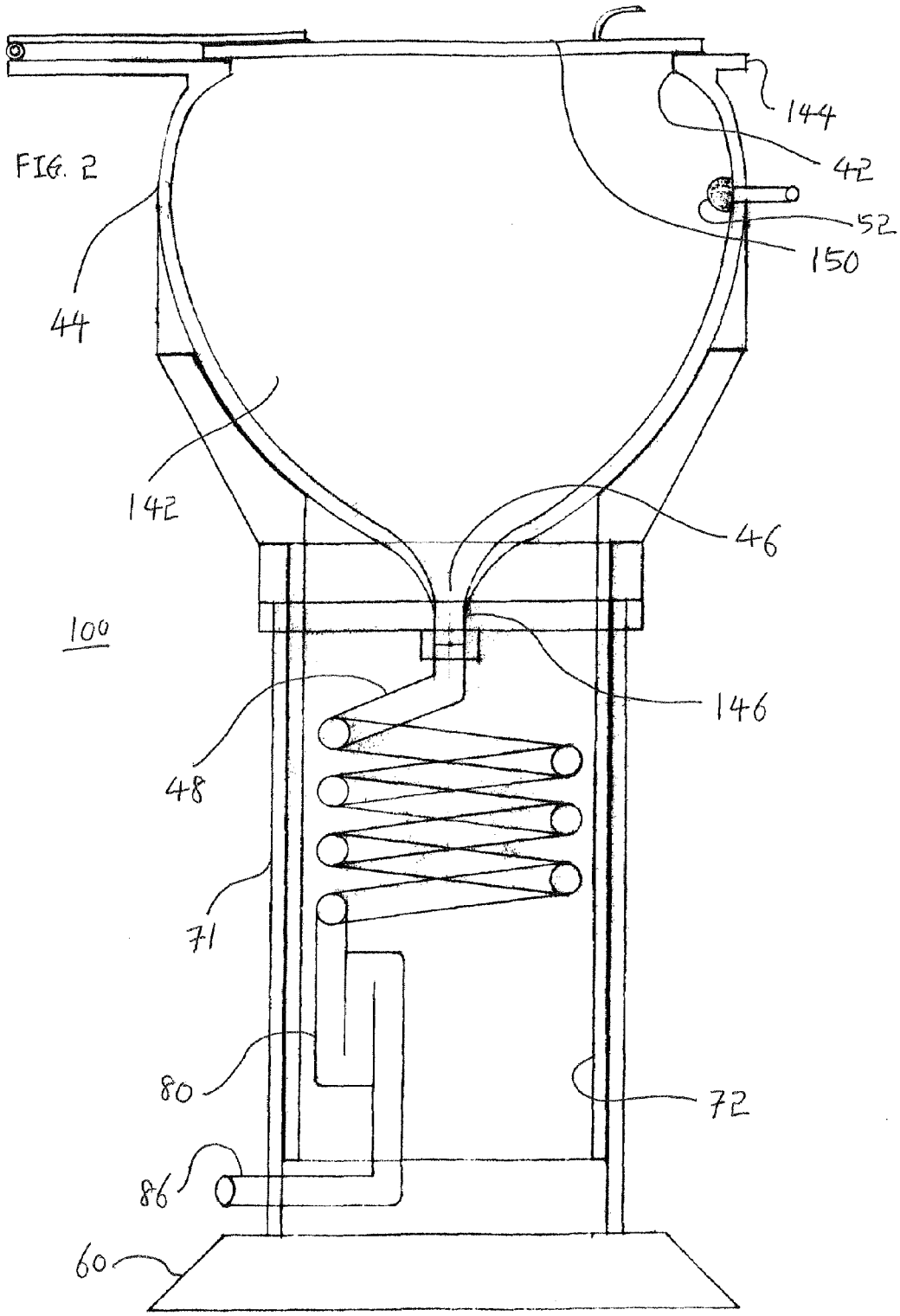
FIG. 2 is a cross-sectional view taken along line II-II in FIG. 1.
Figure 3:
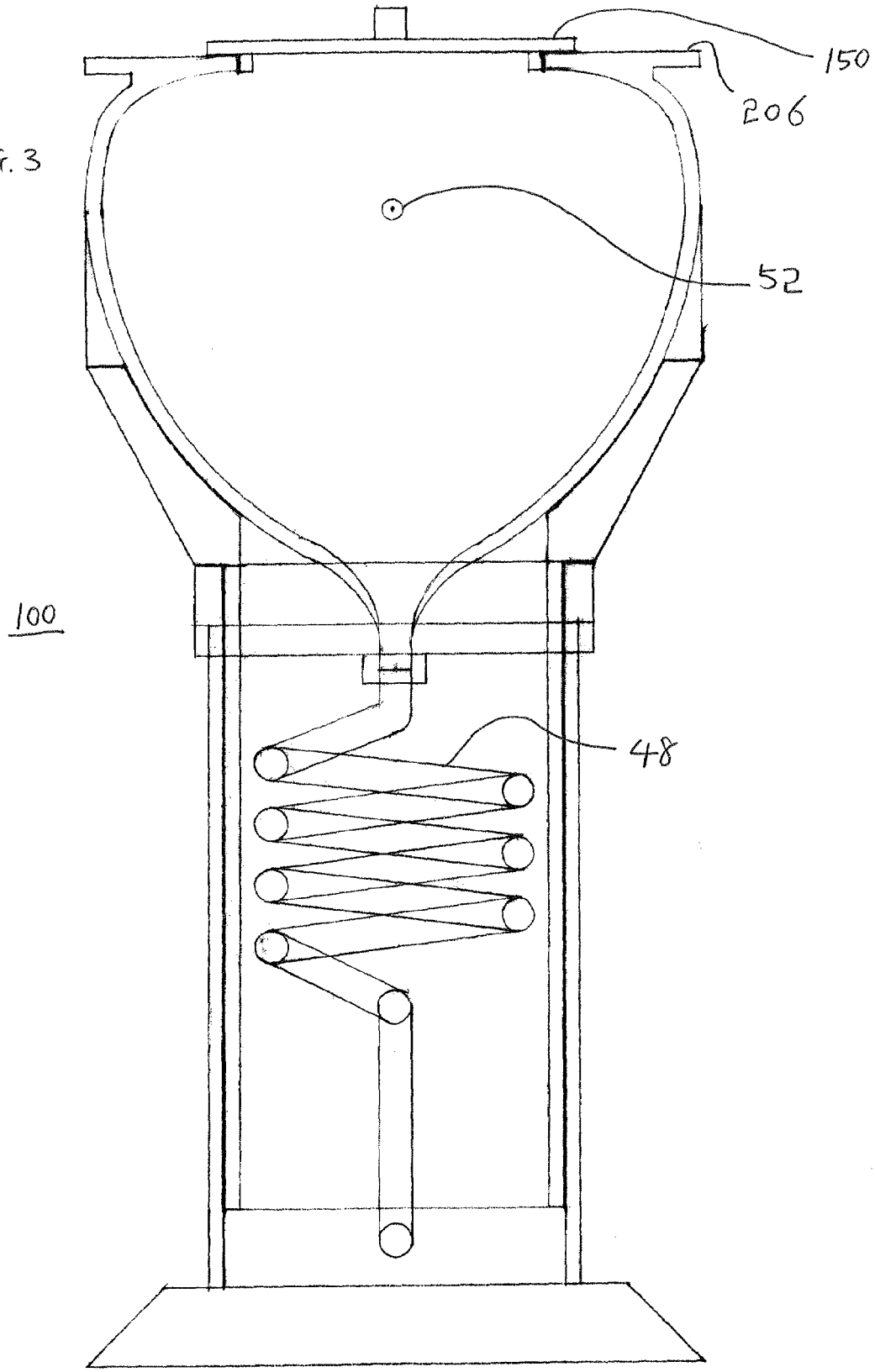
FIG. 3 a cross-sectional view taken along line III-III in FIG. 1.

FIGS. 2 and 3 show that the height adjusting water saving urinal 100 includes a bowl 44, a top opening 42, a bottom drain opening 46, an extendable urinal drain pipe 48, and a connecting device 86.

The bowl 44 has a basin 142, a top portion 144, and a bottom portion 146. The top opening 42 is provided at the top portion 144 of the bowl 44. The bottom drain opening 46 is provided at the bottom portion 146 of the bowl 44. The extendable urinal drain pipe 48 extends from the bottom drain opening 46. The connecting device 86, provided at an end of the extendable urinal drain pipe 48, is for connecting the urinal 100 to the flush toilet system 84.

The extendable urinal drain pipe 48 of the urinal 100 may open to the concave water pan 14 of the flush toilet 10. The water level of the concave water pan 14 is lower than the level of the bottom drain opening 46 of the urinal 100.

The height of the urinal 100 is controllable by the extendable urinal drain pipe 48.

Referring back to FIG. 1, the height adjusting water saving urinal 100 further includes a foot lever 54 for controlling the height of the extendable urinal drain pipe 48.

As shown in FIG. 2, the urinal 100 further includes a nozzle 52 provided at the inside edge of the urinal 100. And, the height adjusting water saving urinal 100 further includes a second water intake (not shown) connected to the nozzle 52 of the urinal 100 and a flush lever (not shown) for controlling the flow of water to a second water intake (not shown).

The nozzle 52 is adapted to change the direction and types of flow. The pressure of a running water system (not shown) makes water squirt to wash out the inside the urinal 100 and even the bottom of the user. The types of flow may include soaking, rinsing, and squirting. The nozzle 52 functions as a bidet for a female user.

The urinal 100 may further include one or more nozzles (not shown) provided along the inside edge of the urinal 100. The nozzles are connected directly to the running water system. The nozzles are used to wash the basin after urinating for both male and females users.

The urinal 100 is adapted to detachably attach to the flush toilet 10.

The height adjusting water saving urinal 100 further includes a support 60 for supporting the urinal 100 and the outer pipe 71. The extendable urinal drain pipe 48 must be a big plus for the people. Since the height of a regular flush toilet is fixed to the height for the sitting position, it is very hard for a man to use it cleanly with no spittle just for the urine.

The height adjusting water saving urinal 100 further includes an S-shaped pipe portion 80 for keeping gas within the drain pipes.

The urinal 100 uses approximately twenty (20) to thirty (30) ounces of water per use, which is a lot of saving of water compared to the case of using the full-fledged flush toilet 10 just for the urine.

The connecting device 86 is adapted to connect the urinal 100 to the flush toilet 10 or directly to a sewer system 37 as shown in FIG. 7.

The height adjusting water saving urinal 100 may also be combined with a well-known bidet system, a bottom washer.

Instead of the running water system connected directly, the urinal may further include a second water tank (not shown).

Figure 4:
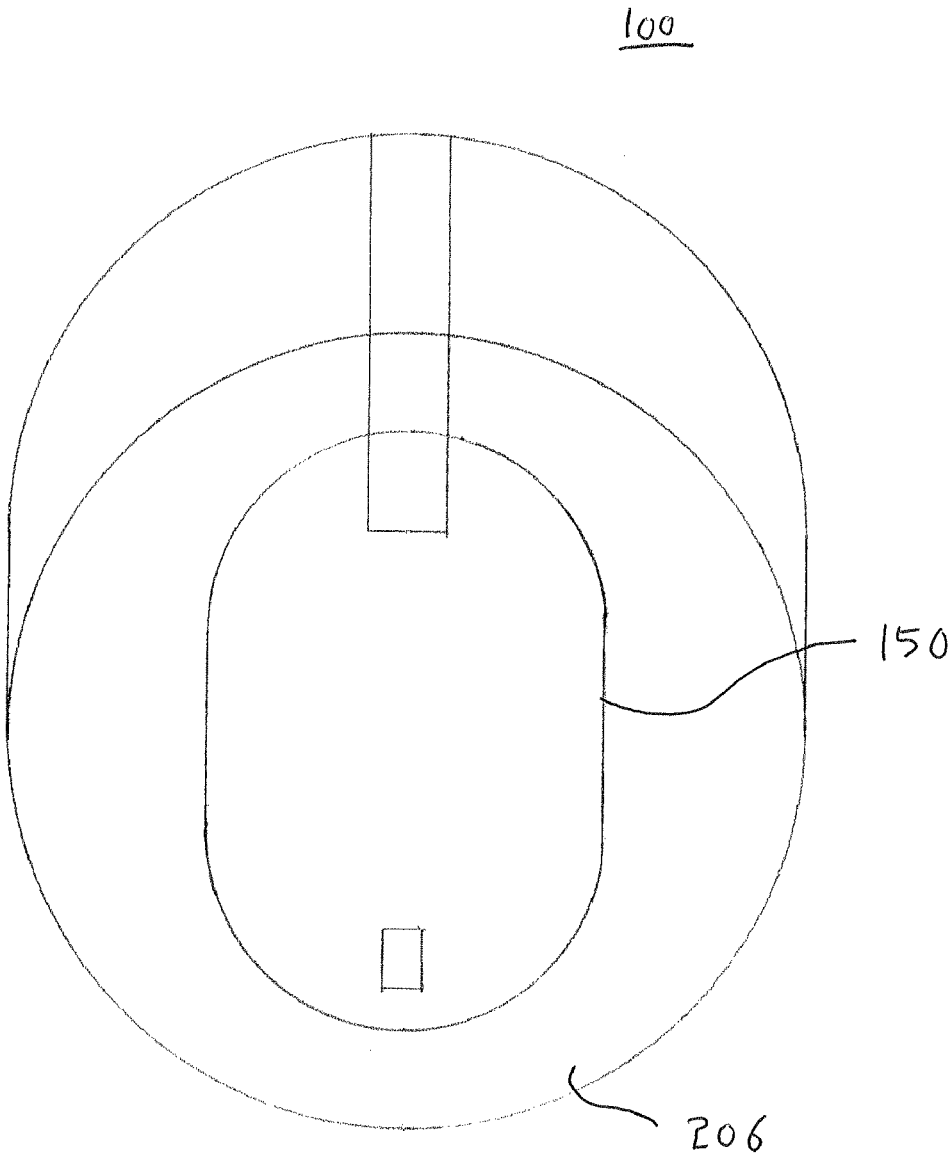
FIG. 4 is a plan view of the urinal.

FIG. 4 shows the view from the top. The urinal may further include a lid 150.

The urinal 100 comprises a seat 206 on which a female user can sit on. The seat 206 is provided on the top opening 42 of the bowl 44.

The height adjusting feature of the urinal 100 is useful when a male user or a female user alternately uses the urinal, or when users having different heights use the same urinal.

Figure 5:
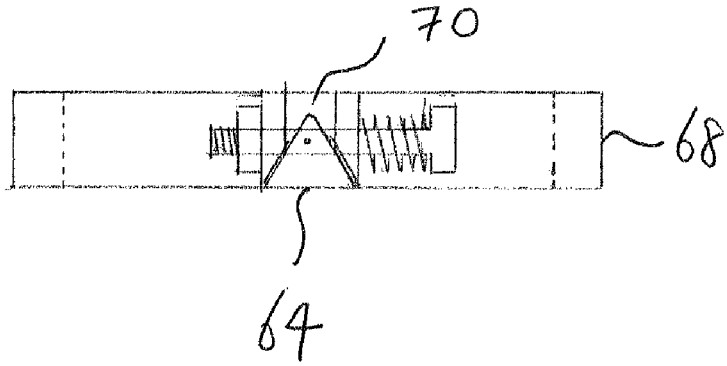
FIG. 5 is an elevation view of a collar.
Figure 6:
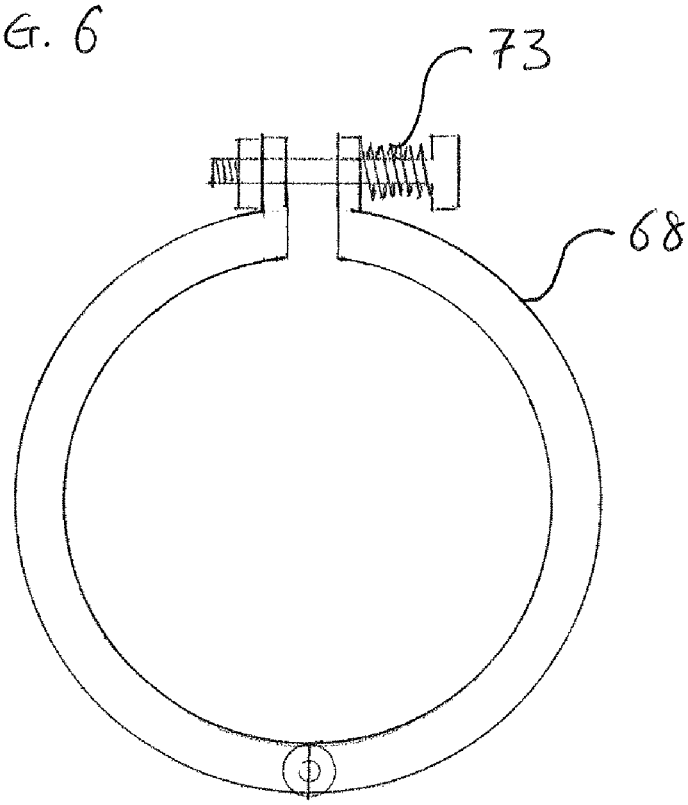
FIG. 6 is a plan view of the collar.

Referring to FIGS. 1, 5 and 6, the urinal 100 comprises the foot lever 54 for controlling the height of the extendable urinal drain pipe 48, a wedge 64, a cable 66 that connects between the foot lever 54 and the wedge 64, and a collar 68 having a gap 70 into which the wedge 64 is pulled by the cable 66. The collar 68 rests on an outer pipe 71, and surrounds an inner pipe 72 that is directed to the bottom drain opening 46. The collar 68 elastically tends to reduce the gap 70 with a spring 73. The wedge 64 adjusts the gap 70 so that the collar 68 is fastened or released around the inner pipe 72.

FIG. 7 shows that a suction device 78 is provided to the flush toilet 10, a suction conduit 80 and a central suction conduit 82. The suction conduit 80 and the suction device 78 are locally provided for each of the toilets in a public restroom to remove foul air. Air is sucked through passages that are normally used for flowing water from the first water tank 20 to the concave water pan 14, and then through the suction conduit 80 with pumping of the suction device 78. The suction conduit 80 has a curved portion 84 that is positioned above the water level of the first water tank 20 so that backflow of water into the suction conduit 80 is prevented.

The size of the water saving urinal is about 9 inches at its longest. A plurality of the water saving urinals can be installed in a public restroom and water and space requirement for a public restroom can be reduced substantially. Also, for a given space of a public restroom, the water saving urinals that can be substantially more in number than conventional toilets may be installed.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A height adjusting water saving urinal adapted to be connected to a flush toilet system having 1) a flush toilet having a top opening, a concave water pan, a bottom drain opening, and a water intake; 2) a first water tank connected to the water intake of the flush toilet; and 3) a first flush system having a flush flipper, a manual handle, and a main drain pipe connected to the bottom drain opening of the flush toilet for flushing out waste-containing water in the concave water pan of the flush toilet, the urinal comprising:

a) a bowl having a basin, a top portion, and a bottom portion;

b) a top opening provided at the top portion of the bowl;

c) a bottom drain opening provided at the bottom portion of the bowl;

d) an extendable urinal drain pipe extending from the bottom drain opening;

e) a seat that is provided on the top opening whereby a female user can sit on the seat;

the urinal further comprising a foot lever, a wedge, a cable that connects between the foot lever and the wedge, and a collar having a gap into which the wedge is pulled by the cable, wherein the collar rests on an outer pipe and surrounds an inner pipe that is directed to the bottom drain opening, wherein the collar elastically tends to reduce the gap, wherein the wedge adjusts the gap so that the collar is fastened or released around the inner pipe, wherein the inner pipe can slide inside the outer pipe.

2. The height adjusting water saving urinal of claim 1, wherein the urinal further comprises a nozzle provided at the inside edge of the urinal.

3. The height adjusting water saving urinal of claim 1, further comprising a support for supporting the urinal and the outer pipe.

4. The height adjusting water saving urinal of claim 1, further comprising an S-shaped pipe portion for keeping gas within the drain pipes.

5. The height adjusting water saving urinal of claim 1, wherein the urinal uses approximately twenty to thirty ounces of water per use.

6. The water saving urinal and toilet system of claim 1, wherein the urinal further comprises a lid.

7. The water saving urinal and toilet system of claim 1, wherein the extendible urinal drain pipe comprises a flexible coiled hose that connects between the bottom drain opening and the connecting device.

8. A flush toilet system comprising:

1) a flush toilet having a top opening, a concave water pan, a bottom drain opening, and a water intake;
2) a first water tank connected to the water intake of the flush toilet;
3) a first flush system having a flush flipper, a manual handle, and a main drain pipe connected to the bottom drain opening of the flush toilet for flushing out waste-containing water in the concave water pan of the flush toilet;
4) a height adjusting water saving urinal connected to the flush toilet;
5) a suction device; and
6) a suction conduit;

wherein the height adjusting water saving urinal comprises:

a) a bowl having a basin, a top portion, and a bottom portion;
b) a top opening provided at the top portion of the bowl;
c) a bottom drain opening provided at the bottom portion of the bowl;
d) an extendable urinal drain pipe extending from the bottom drain opening;
e) a connecting device, provided at an end of the extendable urinal drain pipe, for connecting the urinal to the flush toilet system;
f) a seat that is provided on the top opening whereby a female user can sit on the seat;
g) a foot lever;
h) a wedge;
i) a cable that connects between the foot lever and the wedge; and
j) a collar having a gap into which the wedge is pulled by the cable;

wherein the collar rests on an outer pipe and surrounds an inner pipe that is directed to the bottom drain opening, wherein the collar elastically tends to reduce the gap, wherein the wedge adjusts the gap so that the collar is fastened or released around the inner pipe, wherein the inner pipe can slide inside the outer pipe, wherein the suction device removes foul air from the flush toilet by suction through the suction conduit, wherein the suction conduit comprises a curved portion that is positioned above the water level of the first water tank whereby backflow of water into the suction conduit is prevented.

* * * * *